US005339492A

United States Patent [19]

Billew

[11] Patent Number: 5,339,492

[45] Date of Patent: Aug. 23, 1994

[54] DOORSTOP

[76] Inventor: Dennis Billew, 43 Sandlewood Cir., Lawrenceville, Ga. 30245

[21] Appl. No.: 80,489

[22] Filed: Jun. 21, 1993

[51] Int. Cl.[5] ..... E05F 5/04

[52] U.S. Cl. ..... 16/82; 16/85; 16/86 A; 49/70

[58] Field of Search ..... 49/70; 16/82, 85, 86 R, 16/86 A

[56] References Cited

U.S. PATENT DOCUMENTS

| | | | |
|---|---|---|---|
| 442,759 | 12/1890 | Struss . | |
| 1,598,775 | 9/1926 | Jensen | 16/85 |
| 4,648,152 | 3/1987 | Grewall | 16/82 |
| 4,829,629 | 5/1989 | Van Guilder | 16/85 |

*Primary Examiner*—Philip C. Kannan
*Attorney, Agent, or Firm*—Jones & Askew

[57] ABSTRACT

Improved doorstop composed of an elongated unitary strip of resilient material. The strip is bent to form a substantially closed geometric shape that includes at least one extended substantially flat side for attachment to a wall or baseboard. The second end of the strip lies over the extended flat side and engages same when the apparatus is flexed from contact with a door. The preferred form is trapezoidal in shape and has a resilient deformable pad disposed on the short parallel side. It is also preferred to include a stop at the distal end of the extended flat side to engage the other end when the apparatus is fully flexed.

14 Claims, 2 Drawing Sheets

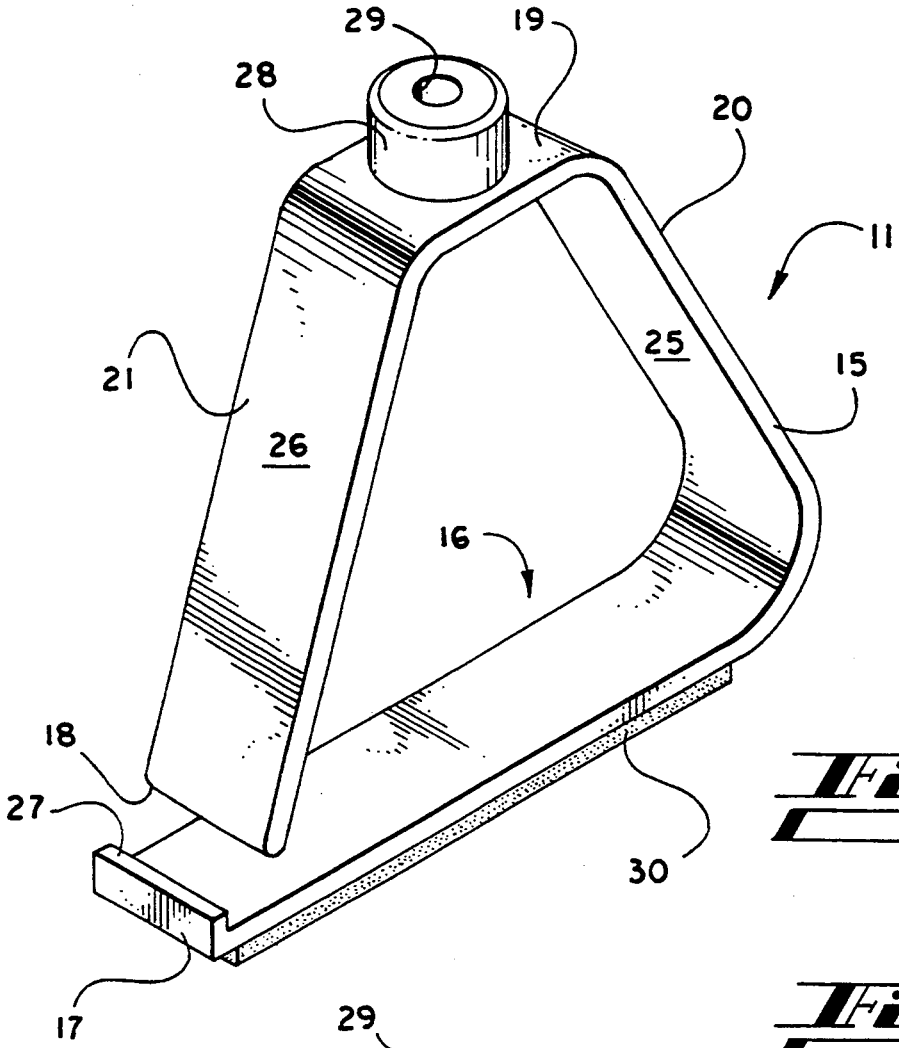
Fig_1
Fig_2
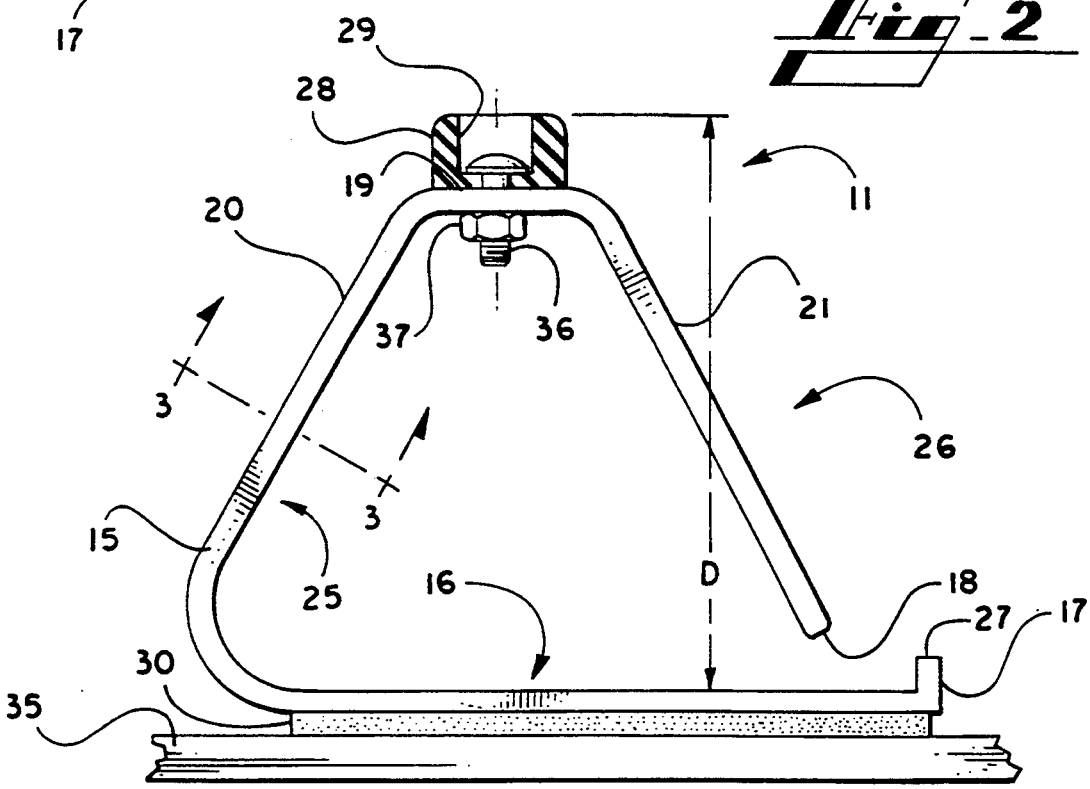

DOORSTOP

TECHNICAL FIELD

The present invention relates to the field of doorstops or door checks that are used to limit the angular travel of a door and thereby prevent its collision with walls, baseboards, or furniture.

BACKGROUND OF THE INVENTION

Doorstops are, in general, relatively commonplace devices that have been in use for many years. The term doorstop is used to refer to both devices for propping doors open and devices for limiting the travel of doors. The present invention concerns a doorstop in the second sense of the word.

Over the years, a number of devices have been employed to limit the travel of a hinged door. They are familiar household and office items. Conventional construction practices normally provide hinged doors in locations where they can be rotated on their hinges far enough to collide with a wall, another door, or a nearby piece of furniture. Common experience teaches that, depending on the distance from the door hinges to the nearest intersecting wall, the edge of the door or its knob hardware can hit or penetrate the material of an adjacent wall. Also, even if the knob hardware is not arranged so as to impact a wall, the leading edge of a door being swung open can, unless otherwise restrained, hit the baseboard on an adjacent wall, chipping paint off of same, and gouging and otherwise damaging the baseboard. Furthermore, in situations in which cabinetry, furniture, or other objects need to be placed in the potential path of travel of the door as it rotates on its hinges, it is desirable to provide an apparatus that limits the travel of the door so as to prevent damaging collisions.

There are a number of doorstop devices known in the prior art. While not always safe, they are generally effective. However, most such devices have one or more drawbacks. One of the most common devices used for many years is a straight post secured to a wall or baseboard, the distal end of which is terminated with a non-abrasive resilient compressible or deformable pad. Such devices were generally formed of a metal or wood shank with a threaded wood screw section at one end that is screwed into the baseboard or wall. The distal end of the apparatus is terminated with a pad that strikes the door as it swung open, preventing same from hitting the wall or the baseboard. While these have been successfully used for many years, they have two significant drawbacks. The first is the fact that all the deformability of the structure resides in the pad. Therefore, it tends to be rather stiff. If a door is swung open at a high rate of speed, as it often is when children open a door with excessive enthusiasm, the relatively small contact area and relative stiffness of these devices tend to make an unattractive indentation in a door at the point at which it contacts the pad. Furthermore, as hollow doors have become more and more common in modern residential construction, there has been a greater problem with the potential of such devices puncturing a door when it hits a stop with excessive speed.

A second major drawback of such doorstops is the fact that they are, by their nature, a solid piece of metal firmly secured to a baseboard at about ankle height. Many people are familiar with the painful injuries that are encountered by accidentally running into a doorstop of this type.

The second of the above noted drawbacks is addressed by a modern version of this type of doorstop in which the shaft is formed of a relatively stiff coiled spring. The spring is arranged so that its coils are in complete contact when it is unflexed and it forms a straight shaft under these conditions. Therefore, the geometry of the shaft is stable under forces that are applied to the end of the shaft parallel to its longitudinal axis. This is the direction of force applied by the plane of a door striking the end pad of such a doorstop where the plane of the door is approximately perpendicular to the longitudinal axis of the stop. However, the spring structure will bend and give way in response to forces that are off axis to a considerable degree. Thus, the accidental striking of such a stop as one walks parallel to the wall to which it is affixed normally creates only surprise, rather than painful injuries to the foot, as the spring gives way and bends when one's foot or ankle strikes it. However, it still has the problem of a relatively small contact area and limited resilient deformable material on the end pad that will tend to mar a door that contacts it with sufficient force a sufficient number of times.

More recently, stops have been employed for mounting directly on the hinge pin of a door and providing two shock absorbing pads that intersect a plane of rotation of the structure about the hinge pin. Typically, one pad is fixed relative to the eye through which the hinge pin of the door passes and the other is mounted on a threaded shaft so that the angular distance between the flat face of its pad and the flat face of the fixed pad may be adjusted. By employing this structure, the angle to which the door may be opened before one pad encounters the door and the other pad encounters an adjacent face of a door jamb may be adjusted so as to selectively limit the travel of the door while still assuring that the door surface engages the pad at the desired angle. These are particularly designed to be used in relatively close quarters where a door might, for example, strike a cabinet or other fixture in a bathroom if it is opened too far.

These devices have the advantage of avoiding horizontal protrusions from baseboards or walls that are a necessary part of the use of the other types of stops described hereinabove. The principal drawback of this third type of stop is the fact that the padded surface engaging both the door and the adjacent door jamb or wall is very close to the pivot point of the door hinge. As a result, the width of the door extending from the hinge to the handle acts as a long lever arm that gives the door a large mechanical advantage. In other words, the door acts as a long lever that tends to put very large forces on the small surface areas of the pads that contact the door and the door jamb. This increases the propensity of such devices to gouge both the door and the adjacent jamb, particularly under the influence of enthusiastic openings by children. Experience has also taught that these devices lack the positive stop action one gets from a more conventional post type doorstop. As a result, children can often be seen bouncing on a door that is equipped with this type of stop as it feels spring loaded to them. Furthermore, because of the large mechanical advantage created by the lever arm of the door against the stop, these stops tend to break more frequently than other doorstops.

Half round stops protruding from a floor are also known. These have an advantage of a somewhat higher surface area for encountering the door. However, they create a potential hazard in the floor and are deemed unsightly by many people. They are most commonly used in office environments as opposed to residences.

In particular, the inventor of the present invention encountered a recurring problem with half round doorstops set in concrete floors in commercial office buildings that motivated his consideration of the inadequacy of prior art doorstops. In most commercial construction, the basic flooring in office and warehouse space is a concrete slab. Doorstops are installed in such slab flooring by using a masonry bit to drill holes into which lead inserts are placed that function to expand like molly bolts. Screws are then passed through holes in the base of the half round stops into the lead inserts. The threads of the screws can cut the lead, and the insertion of the screw shaft into the lead causes it to expand and become securely wedged in the hole in the concrete. If the appropriate size combination is not made for lead insert and screw, the fitting can either be too loose, or can fracture the concrete.

It is the inventor's experience that severe impacts of doors against such half round stops have a tendency to cause the frangible concrete to shatter around the lead insert and the doorstop to thus be loosened. The conventional method of repair is to remove the old lead insert, drill a somewhat larger hole in the concrete and insert a larger lead insert for the next installation. This is labor intensive and quite inconvenient. Experience further indicated that the same sort of activity that caused the door to strike the doorstop with sufficient force to crack the concrete around the lead insert was often applied at a time when the doorstop was loose or removed awaiting repair, causing the door to be thrown into the wall that the stop formerly protected, with unfortunate and destructive results. Therefore, while the present invention is certainly not limited to applicability in commercial settings, the original motivation for creating same arose as a result of problems the inventor encountered with conventional floor installed doorstops.

U.S. Pat. No. 442,759 to H. W. Struss showed a two part doorstop that included a curved spring surface with a free end passing through an eye bolt. It was usable both as a door-to-door protective stop or a door-to-wall stop. The eye bolt was used to prevent the free end of the curved spring from encountering the door, and to give support so as to minimize stress on the spring when under compression.

While doorstops are relatively commonplace, the need for same remains. Replacement of baseboard and sheet rock, plaster repair, and the like are expensive jobs. It is highly desirable to have an improved doorstop that is simple and inexpensive to manufacture yet both safe and effective for use in a residence. Furthermore, it is desirable to have such a device that will cause less damage at its point of contact with the door that it encounters than has been conventionally caused by prior art stops, yet can absorb and dissipate the relatively high energy of a door being swung open too rapidly, as is often the case when children open doors.

SUMMARY OF THE INVENTION

The present invention is designed to meet the above described need and to overcome many drawbacks of prior art doorstops. Broadly stated, the present invention is a doorstop constructed from a unitary strip of resilient material bent to form a substantially closed path with at least one extended substantially flat side. The extended substantially flat side is used for connecting the stop to a substantially flat surface such as a wall, section of baseboard, or the door itself. One free end of the strip of resilient material terminates the extended substantially flat side and the other free end loops around so as to be disposed over the extended substantially flat side so that it will encounter same as the stop is flexed in response to encountering a moving door.

The stop also includes a pad disposed opposite the extended flat surface. The pad is preferably disposed at a location on the substantially closed surface that maximizes the distance between the pad's location and the nearest point on the extended substantially flat surface. This is a general way of saying that the pad is disposed so that it will contact the door before another part of the closed surface encounters the door in most normal configurations for using the stop.

The preferred form of the present invention is one in which the substantially closed path is generally trapezoidal in shape. In this form of the invention, the long parallel side of the trapezoid is the extended substantially flat side and the pad resides on the short parallel side of the trapezoidal shape.

Preferably, the resilient material is spring steel or molded polyvinyl chloride (PVC). The pad is resiliently deformable and may be either compressible or not, purely as a matter of design choice. It is preferred to use neoprene rubber to make the pad, but other materials having the basic needed characteristics may be used with equal efficacy.

In the most preferred form of the present invention, the first free end of the bent strip of resilient material, which is at one end of the elongated substantially flat side, has a lip formed therein. This lip acts to stop travel and the other end of strip of resilient material along the elongated flat side when the second end encounters that side when flexed. More specifically, the geometry of the present invention is arranged so that one free end of the strip lies above the elongated substantially flat side so that it contacts the interior surface of the flat side when a door encounters the pad and flexes the structure. This end will slide along the elongated flat side as the apparatus is further flexed under torsion. Thus, the torsion resilience of the bent structure, as well as the resilient deformability of the pad, are two mechanisms that contribute to absorbing the shock of the impact of the door.

If sufficient force is applied and the elongated flat side is sufficiently short, the second end of the unitary strip that lies over the elongated substantially flat side may slide all the way to the end of same and encounter the lip at the first end. When this happens, the sliding vertex between the first free end and various points along the elongated free side no longer slides and the geometry becomes essentially fixed. Under these flexed conditions, the structure becomes more rigid, but is still deformable under torsion and resilient. Thus, striking the lip has the effect of approximating a positive stop to the movement of the door, but the overall resilient flexibility of the entire structure still allows it to give way and absorb the shock of the impact of the door. This, combined with the shock absorbing characteristics of the pad, serve to absorb the impact of the door.

In preferred forms of the present invention the pad resides on a planer portion of the bent unitary strip. This has the effect of placing the pad on a segment of the side of a torsion spring, rather than having it centered on the longitudinal axis of the rigid shaft as was the case in most prior art door stops. This eliminates the very high pressure on a small area of the door when it strikes a stop, as is the case with prior art fixed post and spring post stops described hereinabove. Note that three separate resilient mechanisms are employed during a major impact. The first is the flexing of a portion of the apparatus as the free end contacts the elongated flat side and slides along same. The second mechanism is the resilient deformation of the pad itself. The third mechanism is the more rigid, but still flexible configuration the apparatus assumes when the free end strikes the lip and the basic geometry can no long change, except to the extent the entire structure is compressed by further force from the door.

It should be noted that it is considered within the scope of the present invention to extend the elongated side and eliminate the lip so that the structure simply flattens out when the door is forcefully urged against it and the free end continues to slide along the interior surface of the elongated flat side.

It is therefore an object of the present invention to provide an improved doorstop made of a single resilient strip of material and a pad in which torsional flexing of the resilient material and resilient deformation of the pad both serve as mechanisms to dissipate the energy of an impacting door.

It is a further object of the present invention to provide such a doorstop in which a substantially closed geometry of this strip of resilient material becomes completely closed if the stop is flexed sufficiently so as to add additional resistance to further movement of the impacting door while still giving way so as not to damage the door surface at the area at which it contacts the stop.

It is a further object of the present invention to provide an improved doorstop that is easily manufacturable and inexpensive to construct.

It is a further object of the present invention to provide an improved doorstop that may be easily attached to a wall or baseboard so as to contact a door near the distal edge of same from the axis of the door's hinges, while at the same time not presenting the danger of harmful or painful injuries to the feet or ankles of a person who accidentally kicks the stop.

It is still a further object of the present invention to provide an improved doorstop that will effectively arrest rotational movement of a door about its hinges as normally opened, and also as opened with excessive speed, for example by a child, yet will not mar or punch through the surface of the door that contacts the stop.

That the present invention accomplishes these objects and overcomes the drawbacks of prior art stops will be appreciated from the detailed description of the preferred embodiment to follow.

BRIEF DESCRIPTION OF THE DRAWINGS

FIG. 1 is a pictorial view of the preferred embodiment of the present invention.

FIG. 2 is a top plan view of the preferred embodiment in an unflexed condition attached to a segment of baseboard.

DETAILED DESCRIPTION OF THE PREFERRED EMBODIMENT

Figure 3A:
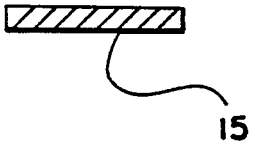
FIG. 3A is a cross section of the preferred embodiment taken along,section line 3—3' shown in FIG. 2.

Turning now to the drawing figures in which like numerals reference like parts, the preferred embodiment of the present invention will now be described. The improved doorstop of the present invention is indicated generally at 11. The stop is constructed from an elongated unitary strip of resilient material 15 bent to form a substantially closed path, in the geometric sense. The substantially closed path includes one extended substantially flat side 16 that is terminated by a first end of the strip 17. The second end of the elongated strip is spaced apart from extended flat side 16 and located over the flat side when the doorstop is in the unflexed condition as illustrated in FIGS. 1 and 2.

As may be seen from inspection of the drawing figures, the preferred embodiment is bent to form an approximation of a trapezoid with a short parallel side 19 being opposite the long parallel side 16. A first non-parallel side 20 lies opposite a second non-parallel side 21 that does not quite extend down to intersect long parallel side 16 when the apparatus is in its unflexed condition. The geometry of the preferred embodiment is such that the bends in the elongated unitary strip 15 define inside surface 25 and outside surface 26. In the preferred embodiment a lip 27 extends above inside surface 25 of the extended long parallel side 16. This lip is not considered necessary to practice broader aspects of the present invention but is a feature of the preferred embodiment. It acts as a stop under certain states of a flexed condition of the apparatus, described in greater detail hereinbelow in connection with FIG. 5.

Lip 27 is unitarily formed with the other portions of elongated unitary strip 15 in the preferred embodiment. It should be understood that other embodiments of the present invention including lip 27 may be constructed wherein the lip is formed from a separate piece that is glued, ultrasonically welded, or otherwise attached to resilient strip 15.

A pad 28 is secured to short parallel side 19 by a bolt (not shown in FIG. 1) that passes through an orifice defined by wall 29. Pad 28 is the structure that contacts a door when the preferred embodiment is installed for normal use. In the preferred embodiment, pad 28 is made of neoprene rubber. However, those skilled in the art of materials will appreciate that a large number of other substitute materials may be used with equal or substantially similar efficacy. The main important characteristics of pad 28 are as follows. First and foremost, it should be non-abrasive so that it will not mar or otherwise injure the surface of the door it contacts during use. This, of course, assumes that it is an apparatus principally designed to be used with wooden doors with a relatively high quality finish thereon. It is preferred that the material from which pad 28 is made be resiliently deformable. This characteristic allows it to be one mechanism that absorbs the energy of the moving door as the elongated strip of the preferred embodiment is flexed and the pad is deformed.

An adhesive foam strip 30 is attached to the outside surface of extended long parallel side 16. Strip 30 is simply a piece of well known double sided adhesive backed foam rubber that is used for connecting two planer surfaces. While double sided adhesive foam is the preferred apparatus for attaching stop 11 to its substantially flat surface, any of a well known and large variety of other structures may be used for securing the stop to a wall or baseboard. For example, double sided adhesive tape without any intervening foam layer may be used. Additionally, extended long parallel side 16 may be tapped with one or more holes, and wood screws or the like may be used to secure stop 11 to a wall or baseboard. Furthermore, glue, toggle bolts, or virtually any other fastener that can tolerate a moderate amount of shearing force between the outside surface of extended side 16 and the surface to which it is attached may be employed without departing from the scope of the present invention. The only important aspect of the adhesive is that it hold the apparatus in place when in use.

Turning next to FIG. 2, a top plan view of the improved doorstop 11 is shown attached to a segment of baseboard 35. Bolt 36, that secures pad 28 to short parallel side 19 is visible in this view. The portion passing through strip 15 and lined within the interior of the cavity formed by wall 29 is shown in phantom. A nut 37 secures bolt 36 in order to hold pad 28 in place.

A dashed dimension line of length D is shown in FIG. 2. Distance D represents the maximum distance between the contact surface of pad 28 and elongated substantially flat side 16. It should be noted that the term maximum distance used in this statement refers to the maximum value of the shortest path between any point on the contact surface of pad 28 and side 16. This is mentioned because, while the preferred embodiment is in the form of a trapezoid, the present invention may be embodied by virtually any substantially closed geometric shape that includes at least an extended substantially flat side such as side 16. When the extended substantially flat side is secured to a wall, the pad should be located so that the shortest distance between the pad and the long flat side is maximized. This is really a geometric description of the desirability of locating the pad as far away on the curved surface as it can be from the long flat side so that the pad contacts the door before it contacts other portions of the elongated strip when the stop is in use.

Figure 3B:
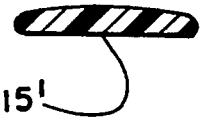
FIG. 3B is a cross section of an alternate embodiment taken along the same section line.

FIGS. 3A and 3B show preferred geometries for cross sections of the elongated strip of resilient material 15 taken along section line 3—3', which is shown on FIG. 2. The preferred embodiment is constructed of spring steel having a rectangular cross section as shown in FIG. 3A. An alternate preferred material is molded polyvinyl chloride (PVC). If PVC is used, it is preferable to have the elongated strip of resilient material approximate the shape of an air foil, as shown in Figure 3B.

Figure 4:
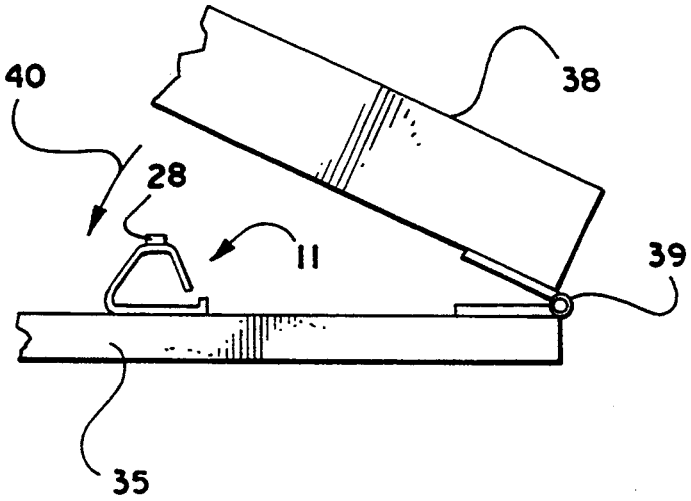
FIG. 4 is a top plan view showing a preferred embodiment installed in a typical setting with a door about to impact same.

FIG. 4 is a simplified drawing showing the preferred embodiment 11 of the improved doorstop installed and in use. It is attached to baseboard 35. A door 38 is mounted on a plurality of hinges, one of which is shown at 39 and is swinging open in the direction of arrow 40 shown in FIG. 4. Door 38 will contact pad 28 when the door opens far enough and begins to flex the structure of preferred embodiment.

Figure 5:
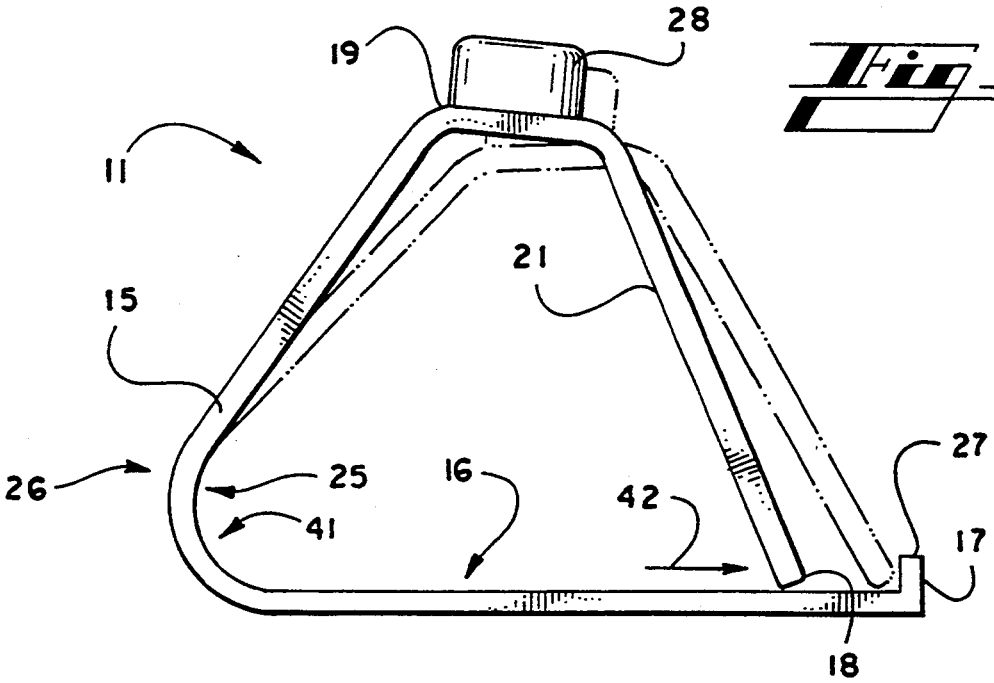
FIG. 5 is a top plan view of the preferred embodiment in a flexed condition.

Turning next to FIG. 5, the operation of the preferred embodiment as it stops a door will now be described. FIGS. 1 and 2 illustrate the preferred embodiment in an unflexed condition. FIG. 5 shows the preferred embodiment in two flexed conditions, one an asserted representation and the other shown in phantom. The door or other object impacting pad 28, which causes the flexing, is not shown in FIG. 5.

As the preferred embodiment encounters a moving door, it moves from its unflexed condition shown in FIG. 2 toward a first flexed condition shown in asserted form in FIG. 5, at which second end 18 of elongated strip 15 contacts extended side 16. In the geometry of the preferred embodiment, most of the bending occurs around curve 41. As force sufficient to overcome the resilience of stop 11 continues to be applied, end 18 slides along extended side 16 in the direction of arrow 42 until it engages lip 27 at end 17 of the elongated strip. This condition is shown in phantom in FIG. 5. As end 18 moves along side 16 the apparatus flexes by diminishing the radius of curvature at bend 41 and increasing the radius of curvature at the two curves that bound short parallel side 19. Additionally, non-parallel side 21 starts to become flexed under torsion, and this flexion continues and is increased when end 18 engages lip 27 stopping further movement of the end 18.

While all of this is occurring, pad 28 is being resiliently deformed and is thus, pushing back on the door or wall that is engaging it.

As an alternative to employment of lip 27, embodiments of the present invention may be constructed in which extended parallel side 16 is extended somewhat farther than illustrated in FIG. 5 so that there is a longer distance over which end 18 will be in contact with the inner surface of side 16 as the apparatus is flexed. This allows the structure to absorb more force than it otherwise could withstand. It is desirable to extend the side so that, under most normal operating conditions, end 18 will not slide off the end of extended side 16 and have an opportunity to mar the surface of the baseboard or wall to which the apparatus is attached.

While preferred forms of the present invention are constructed from elongated unitary strips of a resilient material, it will be apparent to those skilled in the art that embodiments of the present invention may be constructed in which the elongated strip of resilient material is some form of composite made from more that one original piece, so long as it has the required geometry and appropriate resilience. Furthermore, it is preferred to have the strip looped for a consistent definition of inside and outside surfaces 25 and 26 as shown in the preferred embodiment. However, this does not preclude the possibility that the invention might be practiced by a structure in which a 180 degree turn was inserted into the strip so as to approximate the form of a Mobius strip. While the inventor does not currently believe that there is any beneficial utility from such a modification, it should be understood that such a geometry is considered within the scope of the present invention.

The foregoing has been a complete description of the preferred embodiment of the present invention and disclosed what the inventor believes to be the best mode of practicing the invention while, at the same time, trying to point out aspects of the preferred embodiment that are not considered critical or important. In view of the foregoing description of the preferred embodiment, other embodiments of the present invention will suggest themselves to those skilled in the art. Therefore, the scope of the present invention is to be limited only by the claims below and equivalents thereof.

What is claimed is:

1. A doorstop comprising an elongated unitary strip of resilient material having first and second ends, said strip being bent to form a trapezoid having a short parallel side and an extended long parallel side that is terminated by said first end and one non-parallel side that is terminated by said second end, said second end being spaced apart from said extended long parallel side when said doorstop is in an unflexed condition; and a pad secured to said short parallel side.

2. A doorstop as recited in claim 1 wherein said trapezoid defines an inside surface and an outside surface of said elongated unitary strip of resilient material, and further comprising:

means connected to said outside surface at said extended long parallel side for securing said extended long parallel side to a substantially planar surface.

3. A doorstop as recited in claim 1 wherein said trapezoid defines an inside surface and an outside surface of said elongated unitary strip of resilient material, and further comprising:

a lip extending above said inside surface disposed near said first end of said elongated unitary strip of resilient material.

4. A doorstop as recited in claim 1 further comprising:

means disposed near said first end of said elongated unitary strip of resilient material for engaging and stopping movement of said second end of said elongated unitary strip of resilient material when said doorstop is in a flexed condition.

5. A doorstop as recited in claim 1 wherein said pad comprises neoprene.

6. A doorstop as recited in claim 1 wherein said resilient material is spring steel.

7. A doorstop as recited in claim 1 wherein said resilient material is polyvinyl chloride.

8. A doorstop comprising an elongated unitary strip of resilient material having first and second ends, said strip being bent to form a substantially closed path including at least one extended substantially flat side that is terminated by said first end;

said strip being bent so that said second end is spaced apart from and located over said extended substantially flat side when said doorstop is in an unflexed condition; and a pad secured to said elongated unitary strip of resilient material at a location on said closed path that is a maximum distance from any portion of said extended substantially flat side.

9. A doorstop as recited in claim 8 wherein said substantially closed path defines an inside surface and an outside surface of said elongated unitary strip of resilient material, and further comprising:

means connected to said outside surface at said extended substantially flat side for securing said extended substantially flat side to a substantially planar surface.

10. A doorstop as recited in claim 8 wherein said substantially closed path defines an inside surface and an outside surface of said elongated unitary strip of resilient material, and further comprising:

a lip extending above said inside surface disposed near said first end of said elongated unitary strip of resilient material.

11. A doorstop as recited in claim 8 further comprising:

means disposed near said first end of said elongated unitary strip of resilient material for engaging and stopping movement of said second end of said elongated unitary strip of resilient material when said doorstop is in a flexed condition.

12. A doorstop as recited in claim 8 wherein said pad comprises neoprene.

13. A doorstop as recited in claim 8 wherein said resilient material is spring steel.

14. A doorstop as recited in claim 8 wherein said resilient material is polyvinyl chloride.

* * * * *